United States Patent [19]

Bez et al.

[11] 4,234,982

[45] Nov. 25, 1980

[54] VACUUM MATTRESS, ESPECIALLY FOR RESCUE VEHICLES

[75] Inventors: Ulrich Bez, Gerlingen; Wolfgang Bühren, Weissach, both of Fed. Rep. of Germany

[73] Assignee: Dr. Ing. h.c.F. Porsche Aktiengesellschaft, Fed. Rep. of Germany

[21] Appl. No.: 10,996

[22] Filed: Feb. 9, 1979

[30] Foreign Application Priority Data

Feb. 9, 1978 [DE] Fed. Rep. of Germany ..... 2805327

[51] Int. Cl.[3] ..... A47C 27/10; A61G 1/00; A61G 7/00

[52] U.S. Cl. ..... 5/455; 5/424; 5/82 R; 5/449

[58] Field of Search ..... 5/449–456, 5/465, 437, 81 R, 424, 427, 82R

[56] References Cited

U.S. PATENT DOCUMENTS

| | | | |
|---|---|---|---|
| 1,198,687 | 9/1916 | Williams et al. | 5/449 |
| 1,282,980 | 10/1918 | Tukach | 5/455 |
| 1,772,310 | 8/1930 | Hart | 5/465 |
| 2,682,670 | 7/1954 | Crump | 5/449 |
| 3,428,974 | 2/1969 | Stuart | 5/465 |
| 3,608,961 | 9/1971 | Von Heck | 5/453 |
| 4,045,830 | 9/1977 | Loeb et al. | 5/449 |

FOREIGN PATENT DOCUMENTS

| | | | |
|---|---|---|---|
| 2318964 | 10/1974 | Fed. Rep. of Germany | 5/449 |

*Primary Examiner*—Roy D. Frazier
*Assistant Examiner*—Alexander Grosz
*Attorney, Agent, or Firm*—Craig & Antonelli

[57] ABSTRACT

A vacuum mattress having a casing which is loosely filled with a multitude of synthetic resin components so as to enable the mattress to adapt in shape to the body contour of a person thereon, and provided on said casing with a valve for evacuating the mattress so as to retain it in said body contour adapted shape.

10 Claims, 6 Drawing Figures

VACUUM MATTRESS, ESPECIALLY FOR RESCUE VEHICLES

BACKGROUND AND SUMMARY OF THE INVENTION

The invention relates to a vacuum mattress, especially for rescue vehicles, including a casing filled with a multitude of components consisting of synthetic resin, e.g. polystyrene, on which casing a valve is placed for evacuation.

Mattresses of the aforementioned type are especially well suited for mobile emergency units, such as, for example, rescue vehicles. The traumatized person is laid on the mattress which adapts itself to the shape of his body because of its construction. The casing is subsequently evacuated, whereby the mattress insures that the patient is immobilized and forms a transportable unit together with the patient. Studies specific to rescue actions have demonstrated that there is a series of injury categories, e.g. compound fractures, damage to the spinal column, and like injuries, which require a defined adaptation of the mattress or the immobilization of the patient, as well as the taking into account of the vibrations occurring during transport. These demands cannot be met with conventional mattresses.

It is, therefore, an object of the invention to create a vacuum mattress which can be effectively used to carry persons having various and severe types of injuries.

This object is met, according to a preferred embodiment of the invention, in that the mattress has several elements capable of being evacuated separately and/or together. In this connection it is advantageous if a middle element is bordered by two lateral elements. The lateral elements are formed as supports and extend beyond the lying surface of the middle element. The mattress is formed by elements subdivided in its longitudinal direction. Moreover, the elements are constructed in such a way that there results one head section, and two body sections of approximately the same size. The elements are firmly interconnected. However, there is also the possibility of detachably interconnecting at least one portion of the elements. It is also advantageous if valves are provided at least between one portion of the elements. These valves can be actuated in a pressure-dependent fashion. Further, it is advantageous if the mattress has means for transport on its underside. The means can be formed by a rope which locally has loops for fastening it to a stretcher.

Among advantages especially obtained with the invention is that the vacuum mattress, including several elements, is readily adaptable to specific types of trauma in persons and makes it possible to totally or partially immobilize that person. Thus, the elements in the area of fractures of the extremities can be utilized for special support in that the rigidity of the shape of this element is increased by greater evacuation. Insofar as it is necessary to leave the mattress soft in such an area, then this is possible by the fact that the elements can be evacuated separately. Should it be necessary to firmly secure the traumatized person in bed, i.e., total immobilization, and to secure him from vertical jolts, then the lateral elements can be employed to firmly surround the patient.

These and further objects, features and advantages of the present invention will become more obvious from the following description, when taken in connection with the accompanying drawings which show, for purposes of illustration only, several embodiments in accordance with the present invention.

DETAILED DESCRIPTION OF THE PREFERRED EMBODIMENT

Figure 2:
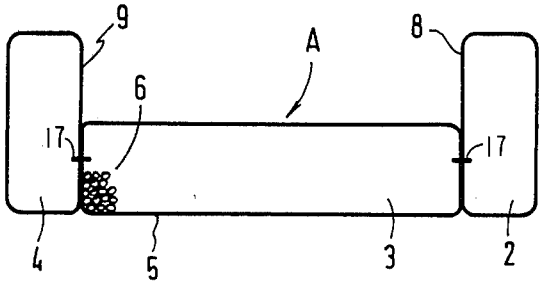
FIG. 2 shows a section along line II—II of FIG. 1.

The vacuum mattress 1 is formed by several elements 2, 3, 4. Each element, for example element 2, includes a casing 5 which is filled with components 6 made of synthetic resin, for instance, polystyrene (FIG. 2). The element 2 has a valve 7 for evacuation.

In the embodiment, the middle element 3 is bordered by two lateral elements 2, 4. The lateral elements 2, 4 extend beyond the lying surface A of the vacuum mattress 1 with sections 8, 9, so that these same elements act as supports.

Besides the subdivision of the mattress 1 in a cross direction B—B, this mattress is also subdivided in a longitudinal direction C—C. Accordingly, two body sections 10, 11 of equal size and one smaller head section 12 are put together. In a cross direction of these sections, the structure of each section corresponds to that already described (elements 2, 3, and 4).

Figure 3:
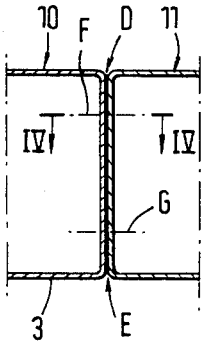
FIG. 3 shows a section along line III—III of FIG. 1 on an enlarged scale.
Figure 4:
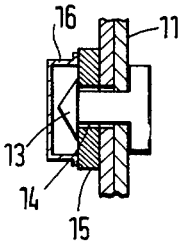
FIG. 4 shows a section along line IV—IV of FIG. 3.
Figure 5:
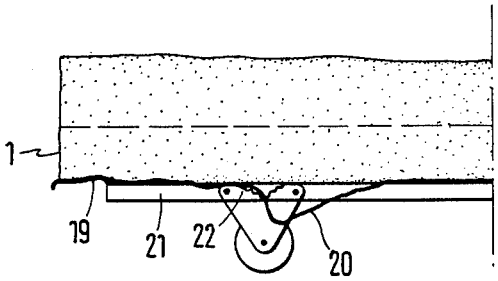
FIG. 5 shows a partial lateral view of the vacuum mattress.

According to FIG. 3, the middle elements 3 of the body sections 10, 11 are mutually connected by welding at D and E. The same manner of attachment can also be employed for connecting the other elements. But for specific purposes, it is also within the scope of the invention to detachably interconnect the elements, and FIG. 4 shows one possible embodiment. In accordance therewith, an elastic lug 13 is provided on an element of the body section 11, which lug extends through an opening 14 and behind a plate 15. The opening 14 is covered by a concealing means 16. The lug 13 extends along planes F and G, respectively.

Figure 6:
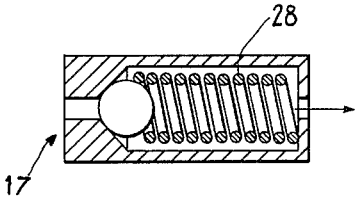
FIG. 6 illustrates a valve for use as part of the mattress.

The central valve 7 can serve to evacuate the mattress 1 wherein the elements 2, 3, 4 and the elements of the body sections 10, 11 and head section 12 are interconnected by way of valves 17 or via through-ducts 18. Any suitable one-way valve can be used for the valves 17 or in place of through-ducts 18 which are only schematically shown in FIGS. 1 and 2. One suitable valve is shown in FIG. 6 and such a valve is known per se such that its manner of construction forms no part of the present invention apart from the way that it is utilized as a part thereof.

Figure 1:
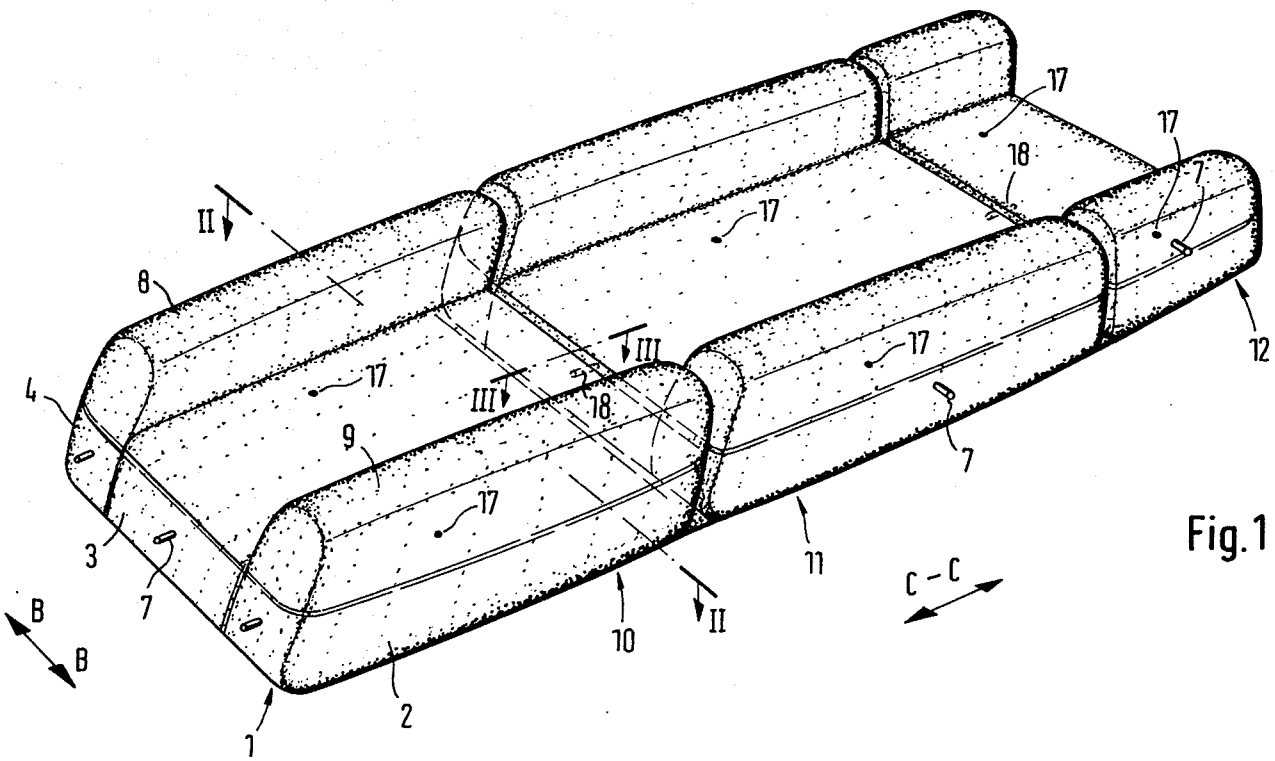
FIG. 1 shows an oblique view of the vacuum mattress according to the invention.

It is self-evident that elements 2, 4 (and the corresponding elements of the body sections 10, 11 and head section 12) can also have external valves such as the valve 7 shown in FIG. 1, and valves 7 can be of the same construction as valve 17. By orienting the one-way valves 17 to permit flow toward the central valve 7, local evacuation can be achieved of varying extents through use of the other valves 7.

It is also within the scope of the invention to cause actuation of the valves 17 between the elements 2, 3 or 3, 4, respectively, in such a manner that element 3 will be evacuated first and then, after a temporal delay, when the pressure in element 3 decreases, elements 2 and 4 are then evacuated. This can be easily achieved by an appropriate selection of the spring constants of the springs 28 of the valves 17 such that the later opening valves require greater opening forces.

For specific cases of application, it can be required to evacuate only elements 2 and 3. For this purpose, only valve 17 between the elements 3 and 4 is closed via a device, not shown.

The vacuum mattress 1 has means for transporting same on the underside. In the embodiment these means are formed by a rope 19. The rope 19 locally has loops 20 which act to fasten the mattress 1 onto a stretcher 21 of a preferably movable construction. For this purpose the stretcher 21 has fastening devices 22.

To further describe the nature of the present invention, its manner of use will now be described. An injured person is placed upon the unevacuated mattress 1 and because the plastic beads 6 are loosely contained within the walls of the elements 2–4, they are able to redistribute themselves therein, under influence of the person's weight, so as to conform to the shape of the person's body. After the mattress has adapted itself to the contours of the injured person's body, the mattress is evacuated by application of any available vacuum source to one or more of the valves 7. By evacuating the mattress casing it is drawn into tight contact with the filler components 6, thereby retaining them in their body conforming configuration so as to insure proper support and/or immobilization of the person carried upon the mattress.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A vacuum mattress comprising a casing means loosely filled with a multitude of synthetic resin components so as to enable the mattress to adapt in shape to the body contour of a person thereon, and means placed on said casing means for evacuating the mattress so as to retain said mattress in said body contour adapted shape, wherein said casing means is subdivided into a plurality of mattress element forming casings arranged in a longitudinal series and each of which includes a middle element bordered by two lateral elements, and wherein said means for evacuating comprises a plurality of external valves and passage means for forming an interconnection between each of said elements, said passage means being comprised at least in part by one-way valves oriented for enabling evacuation of the entire mattress via a first of said external valves and varying degrees of evacuation in at least one selected mattress element via use of at least a second of said external valves.

2. Vacuum mattress according to claim 1, wherein said passage means are spring closed valves and sequential evacuation is achieved by providing later opening valves with springs having spring constants requiring greater opening forces.

3. A vacuum mattress comprising a casing means loosely filled with a multitude of synthetic resin components so as to enable the mattress to adapt in shape to the body contour of a person thereon, and means placed on said casing means for evacuating the mattress so as to retain said mattress in said body contour adapted shape, wherein said casing means is subdivided into three mattress element forming casings arranged in a longitudinal series and each of which includes a middle element bordered by two lateral elements, the lateral elements forming supports and extending above a body receiving surface of the middle element, and the mattress elements being formed in such a way as to comprise one head receiving section and two adjacent body receiving sections, said body sections being of approximately the same size and larger than said head receiving section, and wherein said means for evacuating comprises a plurality of external valves and passage means for forming an interconnection between each of said elements, said passage means being comprised at least in part by one-way valves oriented for enabling evacuation of the entire mattress via a first of said external valves and varying degrees of evacuation in at least one selected mattress element via use of at least a second of said external valves.

4. A vacuum mattress according to claim 3, wherein said one way valves are constructed so as to produce sequential evacuation of at least some of said mattress elements.

5. A vacuum mattress according to claim 3 or 1, wherein said means for evacuating comprises valve means on each of said mattress elements for evacuation thereof.

6. A vacuum mattress according to claim 3 or 1, characterized in that the elements are mutually connected in a permanent manner.

7. A vacuum mattress according to claim 3 or 1, characterized in that at least some of the elements are mutually connected in a detachable manner.

8. A vacuum mattress according to claim 3 or 1, wherein the mattress additionally comprises means for transport on its underside.

9. A vacuum mattress according to claim 8, characterized in that the means for transport includes at least one means for fastening to a stretcher.

10. A vacuum mattress comprising a casing means loosely filled with a multitude of synthetic resin components so as to enable the mattress to adapt in shape to the body contour of a person thereon, and means placed on said casing means for evacuating the mattress so as to retain said mattress in said body contour adapted shape, wherein said casing means is subdivided into three mattress element forming casings arranged in a longitudinal series and each of which includes a middle element bordered by two lateral elements, the lateral elements forming supports and extending above a body receiving surface of the middle element, and the mattress elements being formed in such a way as to comprise one head receiving section and two adjacent body receiving sections, said body sections being of approximately the same size and larger than said head receiving section, wherein said means for evacuating comprises an external valve and interconnecting passage means between each of said elements, said passage means comprised, at least in part, by valves that are spring closed valves actuated in a pressure-dependent manner so as to produce sequential evacuation of at least some said mattress elements by providing later opening valves with springs having spring constants requiring greater opening forces.

* * * * *